US005935029A

United States Patent [19]

Cyr et al.

[11] Patent Number: 5,935,029

[45] Date of Patent: Aug. 10, 1999

[54] SOUND-PRODUCING HOCKEY STICK

[75] Inventors: Terry J. Cyr, Palo Alto; Terry J. Sanchez, Half Moon Bay, both of Calif.

[73] Assignee: OddzOn, Inc., Napa, Calif.

[21] Appl. No.: 08/881,472

[22] Filed: Jun. 24, 1997

[51] Int. Cl.[6] ..... A63B 59/12

[52] U.S. Cl. ..... 473/563

[58] Field of Search ..... 473/563, FOR 189, 473/560–562

[56] References Cited

U.S. PATENT DOCUMENTS

| | | | |
|---|---|---|---|
| D. 343,664 | 1/1994 | Maguire . | |
| 519,770 | 5/1894 | McNaughton . | |
| 870,041 | 11/1907 | Lundberg . | |
| 1,113,162 | 10/1914 | Murphy . | |
| 1,744,862 | 1/1930 | Blethen . | |
| 3,048,399 | 8/1962 | Breitbach . | |
| 3,162,443 | 12/1964 | Petri . | |
| 3,173,688 | 3/1965 | Green . | |
| 3,561,760 | 2/1971 | Klay | 473/563 |
| 4,148,483 | 4/1979 | Sweet et al. . | |
| 4,274,634 | 6/1981 | Berluti . | |
| 4,330,124 | 5/1982 | Vettorello . | |
| 4,340,224 | 7/1982 | Staats | 473/563 |
| 4,343,468 | 8/1982 | Lindgren . | |
| 4,443,013 | 4/1984 | Burt . | |
| 4,836,543 | 6/1989 | Holzer . | |
| 4,840,371 | 6/1989 | Harris . | |
| 4,844,478 | 7/1989 | Kessler . | |
| 4,891,175 | 1/1990 | Haines . | |
| 5,064,197 | 11/1991 | Eddy . | |
| 5,080,374 | 1/1992 | Yu . | |
| 5,160,147 | 11/1992 | Ping . | |
| 5,179,255 | 1/1993 | Yeh . | |
| 5,188,359 | 2/1993 | Wu . | |
| 5,217,222 | 6/1993 | Rudell et al. . | |
| 5,409,213 | 4/1995 | Yeh . | |
| 5,505,453 | 4/1996 | Mack . | |

FOREIGN PATENT DOCUMENTS

| | | | |
|---|---|---|---|
| 282936 | 2/1966 | Australia . | |
| 1148576 | 6/1983 | Canada . | |
| 3817464-A1 | 11/1989 | Germany . | |
| 1750709-A1 | 7/1992 | U.S.S.R. . | |
| 1383949 | 2/1975 | United Kingdom | 473/FOR 189 |
| 094021334 | 9/1994 | WIPO | 473/FOR 189 |

OTHER PUBLICATIONS

U.S. patent application Ser. No. 08/881,474 of Cyr et al., filed Jun. 24, 1997, and titled Sound Producing Golf Club.

U.S. patent application Ser. No. 09/096,102 of Cyr, filed Jun. 11, 1998, and titled Sound–Producing Bat.

PCT Patent Application No. PCT/US98/11283 of Cyr et al., filed Jun. 2, 1998, and titled Sound Producing Golf Club.

*Primary Examiner*—Mark S. Graham

*Attorney, Agent, or Firm*—Kolisch, Hartwell, Dickinson, McCormack & Heuser

[57] ABSTRACT

A hockey stick is provided with an elongate handle portion and a blade portion coupled to the handle portion. The blade portion holds an impact surface designed to strike a ball or puck when the stick is swung at the ball or puck. The impact surface, blade portion and handle all cooperate to produce a drum-like tone when the ball or is struck. The blade portion includes front and back sections that mate and hold the impact surface therebetween. The front section is provided with a tongue that mates with a groove on the back section and the impact surface has a channel that is held in between the tongue and groove. When the front and back sections are assembled together, the impact surface is tensioned by the tongue and groove to make the impact surface an audibly vibratory member. The assembled front and back sections and the handle portion are hollow within to augment the sound produced by the impact surface. The front and back sections include beveled edges that guide the ball or puck toward the impact surface when the sections strike the ball or puck.

18 Claims, 5 Drawing Sheets

SOUND-PRODUCING HOCKEY STICK

BACKGROUND AND SUMMARY OF THE INVENTION

This invention relates to a hockey stick, and in particular to such a hockey stick with a blade that includes a membrane-like impact surface held by a frame and which produces a sound like a drum being struck when the stick is used to strike an object such as a ball or puck.

An important object of the invention is to offer a hockey stick which will be used by children in playing hockey, or hockey-related games, and which will add a new, audible dimension to such games. The amusing sound that the hockey stick makes with each striking of the ball or puck expands the game from mere passing and shooting into an exciting sound-producing sport.

Another object of the invention is to provide a hockey stick that is small and lightweight so that small children can use it. The blade is made larger than ordinary, and the frame includes a beveled edge that guides the ball or puck into contact with the impact surface even though the child may swing inaccurately and initially hit the ball or puck with the frame. The hockey stick is thus more interesting to, and easily used by, children.

According to a preferred embodiment of the invention, now about to be described in more detail, the hockey stick includes an elongate, hollow handle formed of lightweight plastic with a hand grip at one end. The stick includes a blade attached at an end of the handle opposite the hand grip for striking the ball or puck. The blade extends at an oblique angle from the handle and has a roughly rectangular shape, as in a conventional hockey stick. However, unlike existing hockey sticks, the hitting surface of the blade is a membrane-like impact surface which is held in place by a frame, made of lightweight plastic.

The frame includes front and back sections that mate together to surround and grip an outer edge of the impact surface and hold it tightly so that it vibrates at an audible frequency when struck. The outer edge of the impact surface includes a preformed channel that fits into a tongue and groove in the frame. The front and back sections are held together and coupled to the handle by screws extending through holes in one section into internally threaded bosses in the other section. Tightening the screws clamps the channel in the tongue and groove providing the necessary tension to the impact surface.

The frame sections, when coupled together, form a hollow frame that is acoustically coupled to the impact surface. That is, when the impact surface strikes an object, the surface vibrates at an audible frequency causing a sympathetic vibration in the hollow frame thus producing a drum-like tone that sustains for several seconds. When the frame or handle strikes an object, a similar, sustained, drum-like tone is also produced. An advantage is that the simple sport of striking a ball or puck gains a new, sound-producing dimension that will attract more children into an exciting and physical exercise.

The attractiveness of the stick for use by small children is further enhanced by the light weight, the large blade, and the ball- or puck-guiding beveled edge of the frame. The ease and fun of playing hockey with the stick of the present invention builds the child's interest in sports and confidence in the child's own abilities.

These and other objects, advantages and features which are offered by the present invention will become more fully apparent as the description that now follows is read in conjunction with the accompanying drawings.

DETAILED DESCRIPTION OF THE INVENTION

Figure 1:
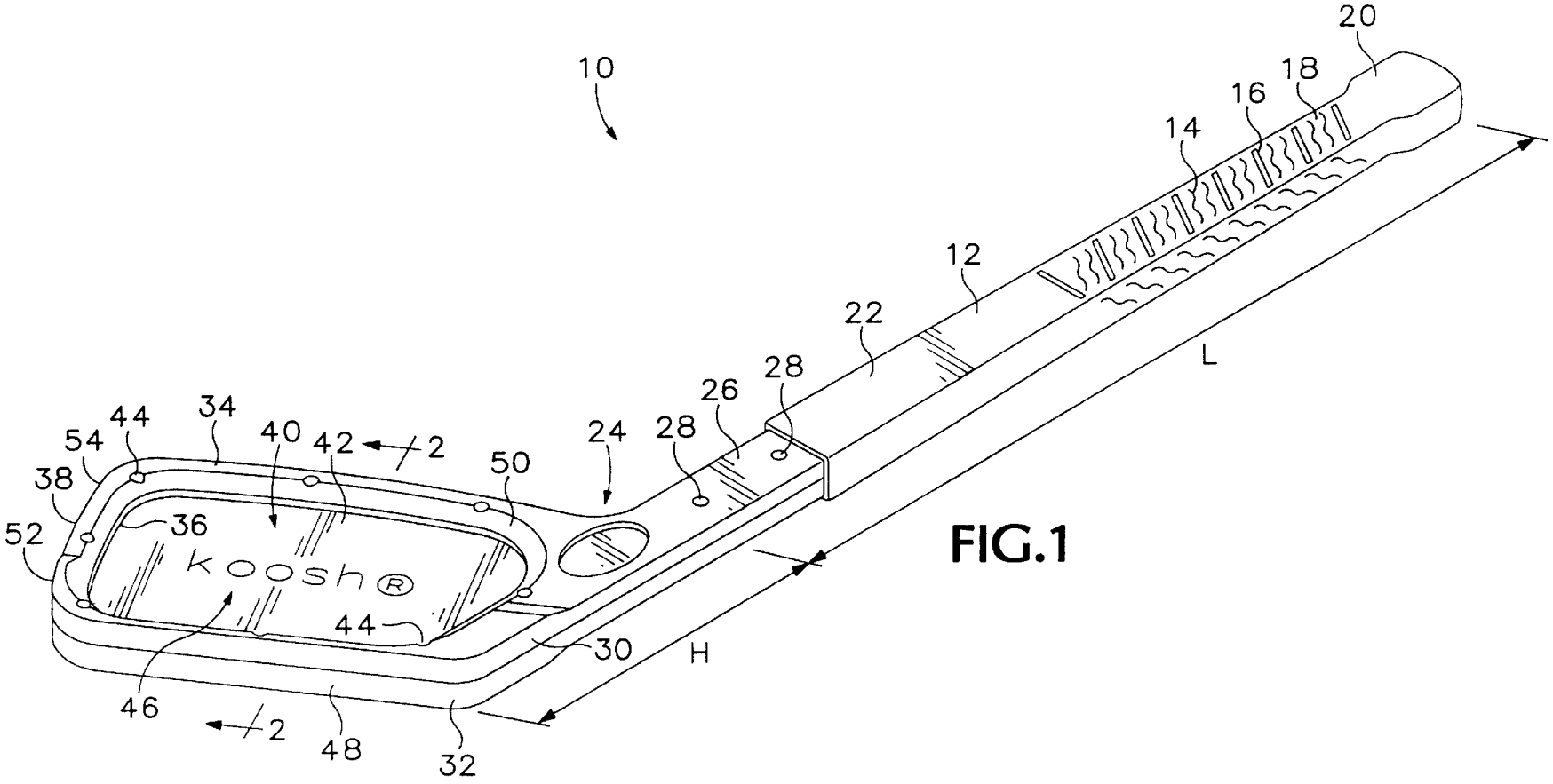
FIG. 1 is a perspective view illustrating a hockey stick constructed in accordance with the present invention with a handle, frame, and impact surface.

Turning attention now to the drawings, and referring, initially, to FIG. 1, a hockey stick or paddle according to the present invention is indicated generally at 10. Stick 10 includes an elongate, hollow, lightweight plastic handle portion 12 with a hand grip 14 at one end. The handle portion is preferably formed from two injection-molded halves which are subsequently sonically welded together. Hand grip 14 includes parallel, angled notches 16 and a roughened surface 18 which are formed during the molding process. An enlarged handle end 20 provides additional security for gripping the handle portion by helping to prevent the handle portion from flying longitudinally out of a user's hand.

At an end 22 of the handle opposite hand grip 14, a striking member, such as blade portion 24, which includes a fastening section 26, is coupled to the handle, preferably by screws installed in holes 28 extending through fastening section 26. Blade portion 24 is formed of lightweight, plastic that is molded in two sections, a first, front section 30 and a second, back section 32. The hockey stick may be used equally well to strike a ball with either the front or the back section forward. The features of the invention that are described herein as being placed on one section may be switched to the other section with no loss of function.

Blade portion 24 includes a frame 34 having an inner edge 36 and an outer edge 38. Inner edge 36 defines an impact region 40 that is spanned by an impact surface, such as membrane 42 that is preferably formed separately from the frame and preferably made of mylar or other plastic. The impact surface is held in place adjacent frame 34 by being pinched or clamped between the front and back sections. Screws installed in preformed holes 44 in front section 30 hold the front and back sections together. The impact surface may alternatively be coupled to the frame by other means such as gluing, stapling, or welding. Preferably, inner edge 36 substantially surrounds impact surface 42 and impact surface 42 spans the entire impact region. Alternatively, frame 34 may surround impact surface 42 only partly or impact surface 42 may span less than all of impact region 40.

The impact surface is capable of striking and propelling an object, such as a ball or puck, on a generally horizontal playing surface such as a lawn, floor, or street when a user swings the hockey stick into the object. When the object is struck, preferably by impact surface 42 directly but alternatively by frame 34 or handle 12, the impact surface, frame, and handle cooperate to produce a sound. The impact surface is held under tension in the frame so the sound has tonal characteristics similar to the sound that a drum emits when it is struck. The sound or tone sustains for a period of time before dying away.

In the disclosed embodiment, impact surface 42 is made of a substantially transparent material which permits the child to see the ball or puck through the impact surface during play when it would otherwise be hidden by the blade. The impact surface can be marked with indicia 46 to identify the child's team or the source of the hockey stick.

Frame 34 includes a substantially straight bottom edge 48 that is angularly offset relative to the longitudinal axis of the handle. Frame 34 has a height H defined along a side. Handle portion 12 has a length L defined along its longitudinal axis. The handle portion's length is greater than the height of the frame and preferably is at least two times the height of the frame. The ratio used in the disclosed embodiment is a handle portion's length slightly more than three times the frame's height. The size for the stick in the disclosed embodiment is a handle portion's length of about 20-inches and a frame's height of about 6-inches. In use, a child holds the stick at hand grip 14 so that bottom edge 48 of frame 34 extends down to the lawn, floor, or street. In such a playing stance, the bottom edge is easily held substantially parallel and in close proximity to the floor, lawn, or street.

Frame 34 also includes on front section 30 a beveled edge 50 inclined toward impact surface 42. When a child swings the hockey stick at a ball or puck, the ideal result for propelling the ball or puck and making a loud sound is for the impact surface to directly strike the ball or puck. However, the child learning to coordinate gross motor skills, or even the more coordinated child in the course of a spirited game, may swing the stick so that the ball or puck is initially struck by the frame. In such a case, beveled edge 50 aids in guiding the object toward the impact surface resulting in the maximum propelling of the ball or puck and maximum sound production. Back section 32 includes a similar beveled edge.

Figure 2:
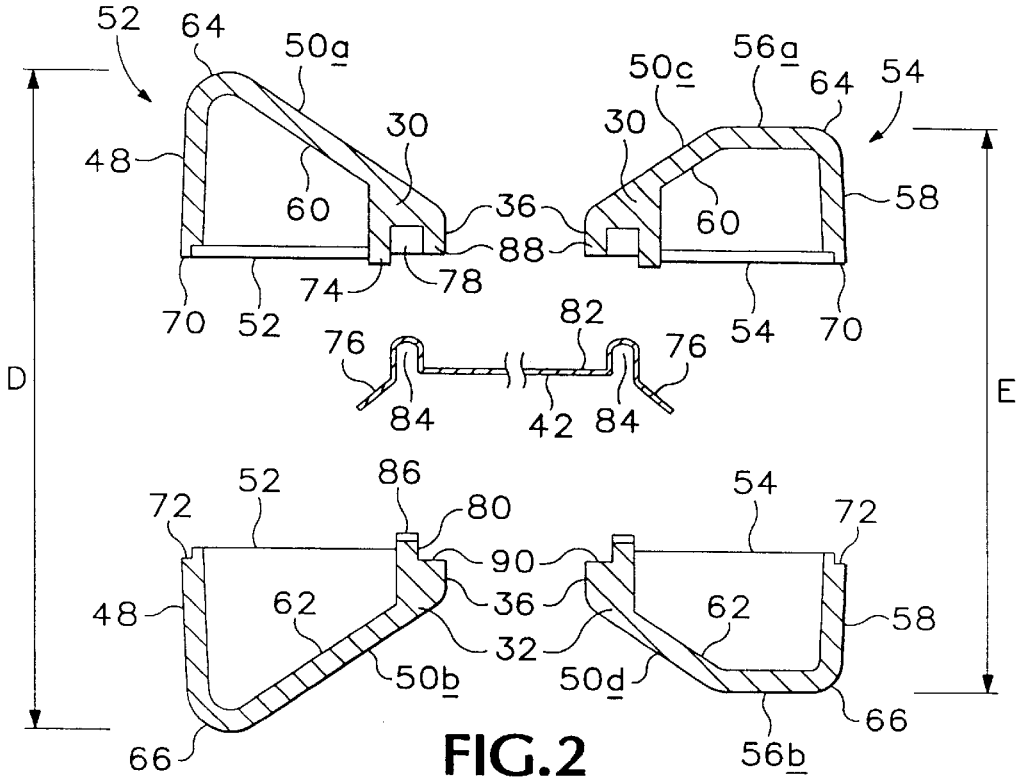
FIG. 2 is a cross-sectional, exploded view of the hockey stick of FIG. 1 showing an edge of the impact surface fitting into a tongue and groove on front and back sections of the frame.

Frame 34 has an upper portion 54 and a lower portion 52 opposite the upper portion. Lower portion 52 includes bottom edge 48. Lower portion 52 is wider in a dimension D from the front to the back of the frame than upper portion 54, which dimension is shown at E. As best shown in FIG. 2, the width difference between the upper and lower portions permits the beveled edge, which is at a constant angle relative to the impact surface on all parts of the frame, to have a different aspect on lower portion 52 as opposed to upper portion 54. On lower portion 52 of frame 34, beveled edges 50*a* 50*b* extend from inner edge 36 substantially to bottom edge 48. On upper portion 54 of frame 34, beveled edges 50*c*, 50*d* extend to flat portions 56*a* 56*b* which are substantially parallel to the impact surface and adjacent an upper edge 58 of frame 34. Having beveled edges 50*a*, 50*b* extend substantially to the bottom edge on the lower portion is advantageous because the lower portion of the frame is more likely than the upper portion to strike the ball or puck when the child swings inaccurately. Beveled edges 50*a*, 50*b* give the child the maximum error correction possible for a ball or puck being struck by the lower portion of the frame.

Figure 3:
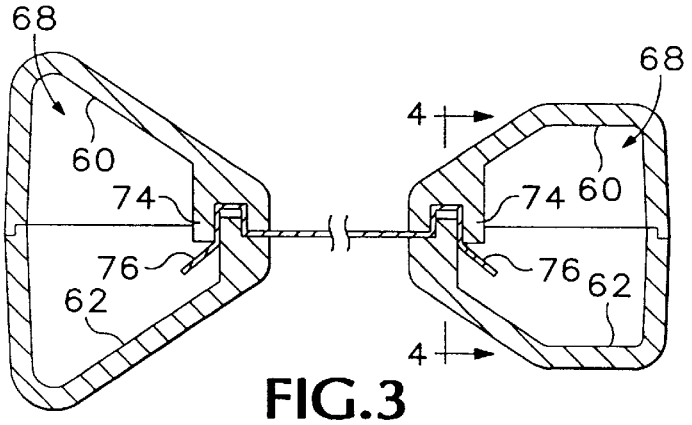
FIG. 3 is a cross-sectional view similar to that of FIG. 2 but with the front and back sections assembled together, holding the edge of the impact surface.

Front section 30 and back section 32 each have an inner surface 60, 62 and an outer surface 64, 66. When the sections are assembled together, as seen in FIG. 3, the inner surfaces define a cavity 68. The cavity is advantageous in enhancing the sound produced by the stick both because air resonates in the cavity and because the cavity makes the frame more light weight and thus responsive to the vibrations of the impact surface.

Figure 6:
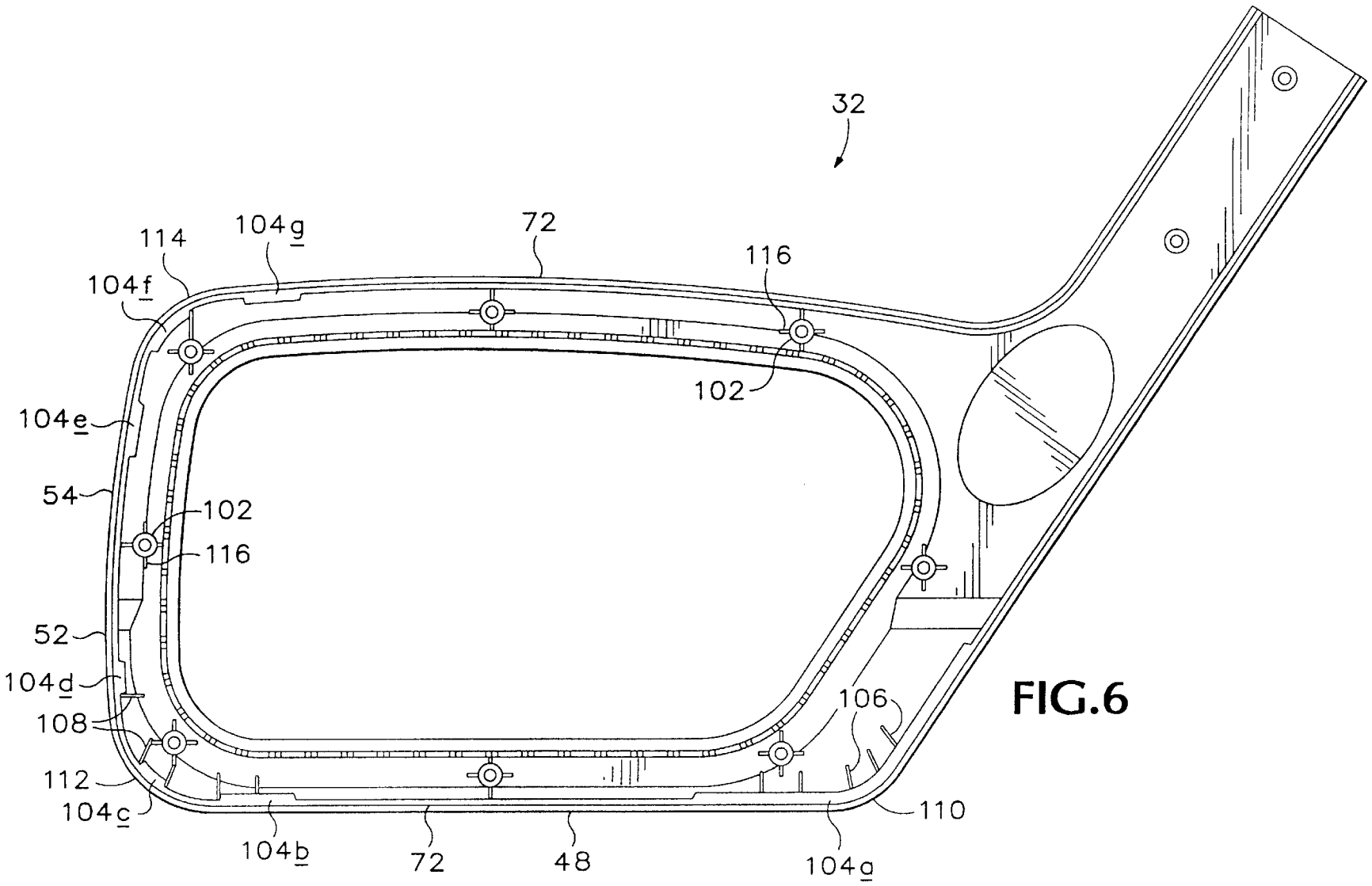
FIG. 6 is a top plan view of the back section of the hockey stick of FIG. 1 showing the reinforced portions of an outer edge of the section.
Figure 7:
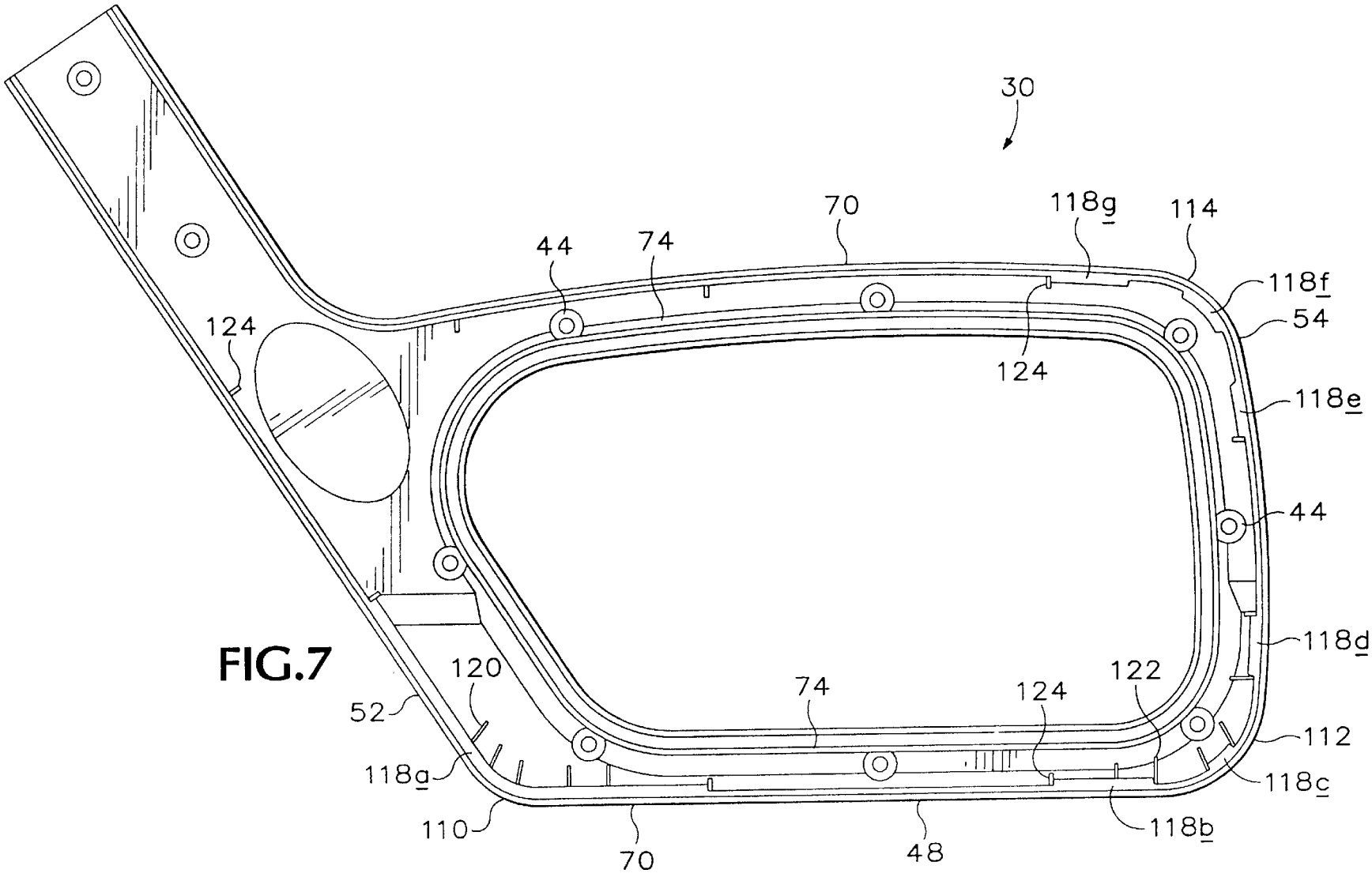
FIG. 7 is a top plan view of the front section of the hockey stick of FIG. 1 showing the reinforced portions of an outer edge of the section.

Referring to FIG. 2, and also FIGS. 6 and 7, the front and back sections include several features for aligning the sections during assembly and securing the two sections together as well as securing the impact surface therebetween. At the outer edge, front section 30 includes an outer flange 70 that extends all the way around the front section. Outer flange 70 mates with an outer notch 72 on back section 32 which likewise extends all the way around the back section. Moving toward inner edge 36, FIG. 2 next shows a raised shoulder 74 that contacts an outer skirt 76 of impact surface 42 during assembly and presses the skirt when the sections are screwed together to help hold the impact surface tightly in place. Adjacent shoulder 74 on front section 30 is groove 78 which is adapted to receive and mate with a complementary tongue 80 on back section 32. The tongue and groove preferably extend around the entire impact region but alternatively may extend around at least a part of the impact region.

Figure 4:
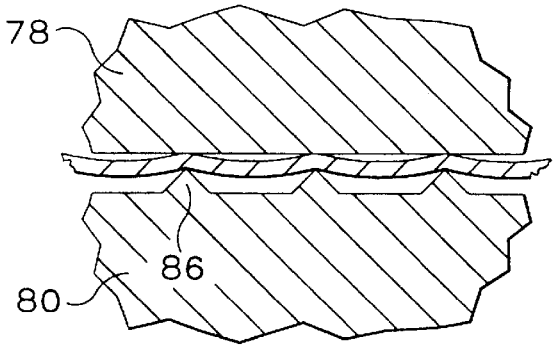
FIG. 4 is a cross-sectional view of the hockey stick of FIG. 3 showing the teeth on the tongue compressing the edge of the impact surface.

Impact surface 42 includes a central hitting surface 82 and a channel 84 preferably surrounding the entire central hitting surface, but alternatively surrounding at least a part of the central hitting surface. The channel may be preformed by pressing it into the impact surface prior to assembly of the hockey stick. When assembled, the channel is held between tongue 80 and groove 78. Raised teeth 86 on tongue 80, best seen in FIGS. 4 and 5, serve to grip and compress channel 84. The outer edge of central hitting surface 82 is held between an inner flange 88 which extends around front section 30 and which mates with an inner notch 90 which likewise extends around back section 32. The pressing of skirt 76 by shoulder 74 and the gripping and compressing of channel 84 by tongue 80, teeth 86, and groove 78 all serve to hold impact surface 42 tightly and to tension and slightly stretch the impact surface so that it will vibrate at audible frequencies when used to strike an object. The holding of the impact surface by the frame also serves to couple the frame acoustically to the impact surface so that a vibration in one will cause a sympathetic vibration in the other resulting in the capability of the stick to produce a drum-like tone.

Figure 5:
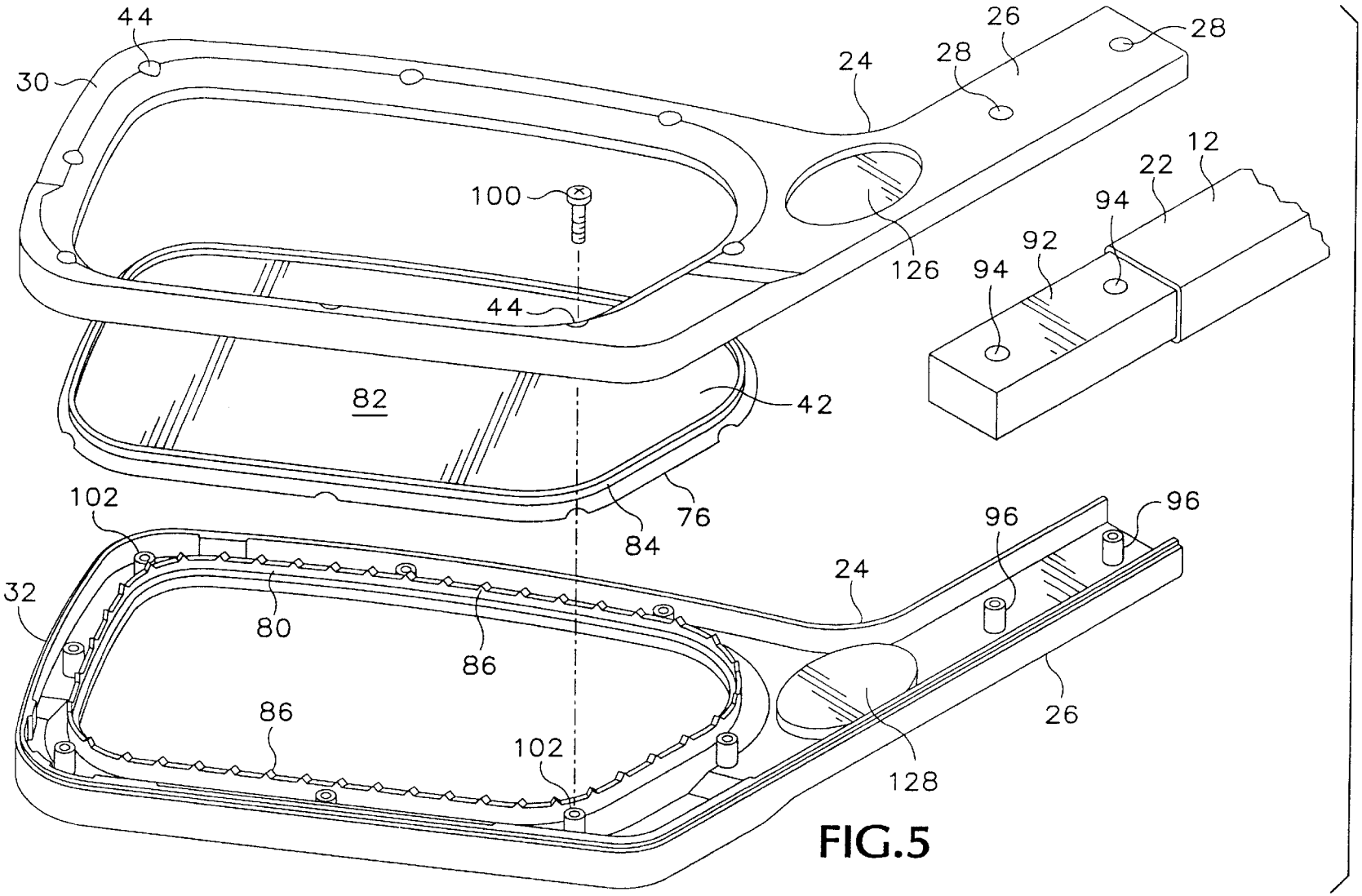
FIG. 5 is a partial, exploded perspective view of the hockey stick of FIG. 1 showing the assembly of the front and back sections with screws through holes in the front sections into bosses in the back section and also showing the coupling between the frame and the handle.

FIG. 5 illustrates that handle portion 12 includes a portion 92 rigidly coupled at end 22. Portion 92 is slightly narrower than the adjacent portion of handle portion 12 to permit a flush attachment of fastening section 26 of blade portion 24. Portion 92 has two pre-formed holes 94 defined therethrough which accommodate two pre-formed, threaded bosses 96 on back section 32 and align with two preformed screw holes 28 on front section 30. When portion 92 is placed in back section 32, bosses 96 extend into holes 94 in portion 92. Front section 30 may then be placed over portion 92 with screw holes 28 on the front section aligned with holes 94 in portion 92. Screws such as screw 100 are installed in holes 94 and screwed in to bosses 96, securing portion 92 between the front and back sections.

Eight pre-formed, mating screw holes 44 and threaded bosses 102 in the front and back sections are used for clamping impact surface 42 in the frame. Although only a single screw 100 is shown, it will be understood that similar screws are installed in each of the screw holes and tightened into bosses 102. Using screws to tighten the front and back sections onto the impact surface is especially advantageous because it provides a controlled, mechanical advantage for tightening pre-formed channel 84 in tongue 80 and groove 78 which stretches the impact surface slightly and tensions it across the impact region so that the impact surface, frame, and handle produce the drum-like tone when an object is struck. The bosses in the disclosed embodiment are threaded, but alternatively, self-threading screws may be used with non-threaded bosses.

FIG. 6 shows that back section 32 includes reinforcements, such as seven thickened wall portions 104*a–g* and two sets of five wall braces 106, 108 that provide extra stiffness and durability to high-wear areas at and near corners 110, 112, 114 and lower portion 52 of frame 34. Each of threaded screw bosses 102 in back section 32 are reinforced by four braces 116 arranged in a cross-shape around the bosses.

FIG. 7 shows that front section 30 includes reinforcements, such as seven thickened wall portions 118*a–g* and two sets of five wall braces 120, 122 that provide extra stiffness and durability to high-wear areas in corners 110, 112, 114 and lower portion 52 of frame 34. Front section 30 also includes nine tabs 124 adjacent outer flange 70 that help to align flange 70 with outer notch 72 on back section 32.

FIG. 5 also illustrates that blade portion 24 includes indentations 126, 128 that are advantageous for displaying embossed indicia (not shown).

While the present invention has been shown and described with reference to the foregoing operational principals and preferred embodiment, it will be apparent to those skilled in the art that other changes in form and detail may be made therein without departing from the spirit and scope of the invention as defined in the appended claims.

It is Claimed and Desired To Secure by Letters Patent:

1. A hockey stick for producing a sound, the stick comprising:

an elongate handle portion;

a blade portion adjacent the handle portion, the blade portion including a frame defining an impact region; and a membrane spanning at least a portion of the impact region, the membrane being held in place adjacent the frame, wherein the membrane is tensed over at least a portion of the impact region;

wherein the membrane is capable of striking and propelling an object; and wherein the membrane and the frame cooperate to produce sound when the membrane strikes the object.

2. The hockey stick of claim 1 wherein the frame substantially surrounds the membrane.

3. The hockey stick of claim 1 wherein the frame includes an outer surface and an inner surface, and where the inner surface defines a cavity.

4. The hockey stick of claim 1 wherein the frame includes a bottom edge that is angularly offset relative to the handle so that the bottom edge may be held substantially parallel to a horizontal playing surface when the hockey stick is in use.

5. The hockey stick of claim 1 wherein the blade portion has a height, the handle portion has a length, and the handle portion's length is greater than the blade portion's height.

6. The hockey stick of claim 5 wherein the handle portion's length is at least two times the blade portion's height.

7. The hockey stick of claim 1 wherein the frame includes a lower portion and a reinforcement on at least a part of the lower portion.

8. The hockey stick of claim 1 wherein the frame includes a corner and a reinforcement adjacent the corner.

9. The hockey stick of claim 1 wherein the frame includes a beveled edge inclined toward the membrane adapted to guide the object toward the membrane.

10. The hockey stick of claim 9 wherein the frame includes a bottom edge and where the beveled edge extends substantially to the bottom edge.

11. The hockey stick of claim 1 wherein the handle portion includes an outer surface and an inner surface and where the inner surface defines a cavity.

12. The hockey stick of claim 1 wherein the membrane is separate from and coupled to the frame.

13. The stick of claim 1 wherein the frame includes a bottom edge that is angularly offset relative to the handle so that the bottom edge may be held substantially parallel to a horizontal playing surface when the hockey stick is in use, a first section having a tongue extending around at least a pail of the impact region and a second section having a complementary groove adapted to receive the tongue, and wherein the membrane is held by the tongue and groove.

14. The stick of claim 13 wherein the membrane includes a central hitting surface and a channel surrounding at least a part of the central hitting surface, a skirt adjacent an outer edge of the channel and the second section includes a raised shoulder adjacent the groove for contacting the skirt and holding the membrane.

15. The stick of claim 14 wherein the tongue of the first section further comprises raised teeth for gripping and compressing the channel of the membrane.

16. The stick of claim 13 wherein the first and second sections further include a plurality of preformed, complementary screw holes and bosses and further comprising screws adapted to secure the sections together and hold the membrane across the impact region.

17. The stick of claim 13 wherein the membrane is comprised of a substantially transparent material.

18. The stick of claim 13 wherein the membrane includes a central hitting surface and a channel surrounding at least a part of the central hitting surface, the channel being held between the tongue and groove so that the membrane is held by the frame across at least a part of the impact region, and wherein the channel is pre-formed prior to assembly of the stick.

* * * * *

UNITED STATES PATENT AND TRADEMARK OFFICE

CERTIFICATE OF CORRECTION

PATENT NO. : 5,935,029
DATED : August 10, 1999
INVENTOR(S) : Terry J. Cyr and Terry J. Sanchez It is certified that error appears in the above-indentified patent and that said Letters Patent is hereby corrected as shown below:

In column 6, line 34, delete "pail" and insert --part-- therefor.

Signed and Sealed this
First Day of February, 2000

*Attest:*

Q. TODD DICKINSON

*Attesting Officer*

*Acting Commissioner of Patents and Trademarks*